United States Patent [19]

Stout et al.

[11] 4,187,447

[45] Feb. 5, 1980

[54] ELECTRODELESS FLUORESCENT LAMP WITH REDUCED SPURIOUS ELECTROMAGNETIC RADIATION

[75] Inventors: Virgil L. Stout; John M. Anderson, both of Schenectady, N.Y.

[73] Assignee: General Electric Company, Schenectady, N.Y.

[21] Appl. No.: 941,126

[22] Filed: Sep. 11, 1978

[51] Int. Cl.[2] ..... H01J 1/52

[52] U.S. Cl. ..... 315/85; 315/54; 315/57

[58] Field of Search ..... 315/57, 85, 54, 248

[56] References Cited

U.S. PATENT DOCUMENTS

| | | | |
|---|---|---|---|
| 3,500,118 | 3/1970 | Anderson | 315/57 |
| 3,521,120 | 7/1970 | Anderson | 315/57 |
| 3,987,335 | 10/1976 | Anderson | 315/57 X |
| 4,005,330 | 1/1977 | Glascock et al. | 315/57 |
| 4,096,556 | 6/1978 | Berger et al. | 362/417 |

*Primary Examiner*—Paul L. Gensler
*Assistant Examiner*—Charles F. Roberts
*Attorney, Agent, or Firm*—Marvin Snyder; Joseph T. Cohen

[57] ABSTRACT

Spurious electromagnetic radiation from an electrodeless fluorescent lamp having a phosphor-coated, globular glass envelope containing an ionizable gas surrounding at least a portion of a toroidal magnetic core is reduced by situating a conductive loop about the envelope such that the loop and core planes are normal to each other. The loop also acts as the harp for a lampshade. Radio frequency energy, coupled into the gas from the core to ionize and excite the gas to emit ultraviolet radiation and thus stimulate visible radiation from the phosphor, also radiates from the lamp. The loop, driven by the radiated radio frequency energy, creates an opposing electromagnetic field. Cancellation of the radiated radio frequency energy thus tends to occur at a distance from the lamp, sharply reducing electromagnetic interference from the lamp.

9 Claims, 5 Drawing Figures

ELECTRODELESS FLUORESCENT LAMP WITH REDUCED SPURIOUS ELECTROMAGNETIC RADIATION

INTRODUCTION

This invention relates to fluorescent lamps constructed as direct replacements for existing incandescent lamps, and more particularly to a substantially globular fluorescent lamp exhibiting marked reduction in radio frequency energy emitted at a distance from the lamp.

The incandescent lamp is presently the primary luminary for household and residential lighting. This lamp generally includes an incandescent filament enclosed in a nonoxidizing atmosphere contained within a light-transmissive envelope and mounted, foe example, upon an Edison-type base to be screwed into a socket.

Despite their widespread use, incandescent lamps are relatively inefficient, producing only 15-17 lumens per watt of input power, and have relatively short, unpredictable service lives. Fluorescent lamps, which have efficiencies as high as 80 lumens per watt, provide an attractive alternative to incandescent lighting. Conventional fluorescent lamps, however, require a long tubular envelope which, together with the need for auxiliary ballasting equipment, has somewhat limited their acceptance in the home lighting market. Increased residential use of fluorescent illumination, with attendant savings of energy, are likely to be achieved from the development of fluorescent lamps which are directly compatible with existing incandescent lamps sockets. Lamps of this type have been described, for example, in J. M. Anderson U.S. Pat. No. 3,987,335, issued Oct. 19, 1976 and H. H. Glascock et al. U.S. Pat. No. 4,005,330, issued Jan. 25, 1977, both of which are assigned to the instant assignee.

Electric discharge devices which produce visible light for general illumination requirements without need for utilizing electrodes as the footpoints of a glow or arc discharge, have long been sought. Although the general concept of electrodeless discharge lamps is known, a major problem in using such lamps is the electromagnetic interference (hereinafter EMI) they generate. Core materials exhibiting the high permeability necessary to assure adequate coupling of radio frequency energy into the gas contained in the lamp envelope are available to permit operation of the core over the frequency range of 25 KHz to 100 MHz. Although high frequency operation is desirable from the standpoint of minimizing core size and core losses, the cost of presently-available semiconductors for use in radio frequency power sources limits the maximum frequency at which an economically practical lamp of this type may be operated to approximately 5 Mhz. Nevertheless, operation even at the relatively low frequency of 50 KHz can produce annoying EMI, affecting radio and television reception within the immediate vicinity of the lamp. Thus a person in a room illuminated by one or more electrodeless fluorescent lamps of the type heretofore described would likely hesitate to operate a radio or television receiver in the same room without elaborate shielding or other means for reducing the EMI or its effect upon radio or television reception.

Accordingly, one ojbect of the invention is to provide an electrodeless fluorescent lamp exhibiting reduced EMI.

Another object is to provide an electrodeless fluorescent lamp having simple means for reducing spurious electromagnetic radiation at a distance from the lamp, without requiring any alteration in the lamp power supply.

Another object is to provide an electrodeless fluorescent lamp having a harp mounted thereabout.

Briefly, in accordance with a preferred embodiment of the invention, a fluorescent lamp exhibiting reduced EMI comprises an evacuable, light-transmissive envelope of generally globular configuration, and a toroidally-shaped magnetic core. A gaseous medium within the envelope sustains an electric discharge when subjected to a radio frequency magnetic field established about the core and emits radiation at a first wavelength when sustaining the discharge. A phosphor coating disposed on the interior surface of the envelope emits visible light when excited by radiation of the first wavelength. A continuous, conductive loop is situated about the envelope and the core, the plane of the loop being oriented substantially normal to the plane of the core, such that any radio frequency magnetic field about the core induces current within the loop that establishes a radio frequency magnetic field tending to cancel, at a distance from the lamp, the radio frequency magnetic field established about the core.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

DESCRIPTION OF TYPICAL EMBODIMENTS

Principles of operation of electrodeless fluorescent lamps are described in J. M. Anderson, U.S. Pat. No. 3,500,118, issued Mar. 10, 1970, and 3,521,120, issued July 21, 1970, both of which are assigned to the instant assignee and incorporated herein by reference.

Figure 1:
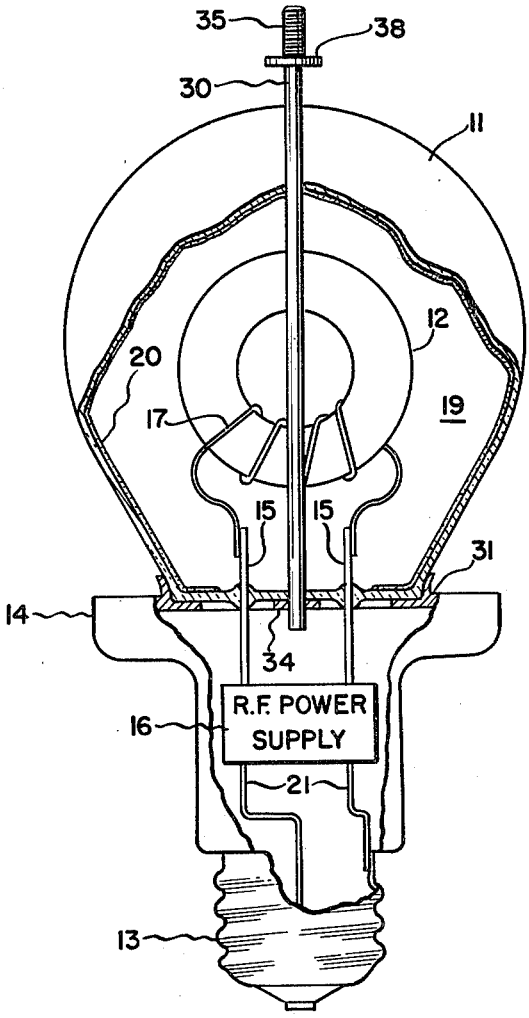
FIG. 1 is a partial sectional view of an electrodeless fluorescent lamp employing the present invention.

FIG. 1 illustrates in partial sectional view, an electrodeless fluorescent lamp having an induction transformer core 12 contained within envelope 11 and surrounded by an ionizable gas 19. Envelope 11 is mounted on a base assembly 14 which supports a standard screw-in plug 13. A radio frequency power supply 16 contained within the base assembly and connected to plug 13 through rigid leads 21 causes current to flow through metal pins 15 and a primary winding 17, establishing a radio frequency magnetic field in toroidal transformer core 12. Radio frequency power supply 16 may be of any type well known in the art such as, for example, the inverter circuit described and claimed in the aforementioned Anderson U.S. Pat. No. 3,521,120, and is commonly referred to as a ballast.

Since ionizable gas 19 links transformer core 12, the radio frequency magnetic field within the transformer core induces an electric field which ionizes and excites the gas. Upon excitation, the gas emits radiation in the ultraviolet region of the spectrum. The interior surfaces of envelope 11 and, if desired, the surfaces of transformer core 12, are coated with an appropriate lamp phosphor 20 of the type, well known in the art, which by absorbing ultraviolet radiation are stimulated to emit radiation within the visible spectrum, producing a highly efficient and pleasing light output. Gaseous medium 19 is typically a mixture of rare gas (for example krypton and/or argon) and mercury vapor and/or cadmium vapor at a pressure of between approximately 0.2 and approximately 3.0 torr at room temperature. Due to the relatively low thermal conductivity of gas mixtures of this type, techniques exist to carry away large quantities of heat that may be produced by losses in transformer core 12 and winding 17, such as by situating a portion of the core outside envelope 11 in the manner described and claimed in the aforementioned Anderson U.S. Pat. No. 3,987,335, or by fabricating core 12 of a low loss, high permeability material, such as ferrite type 8100 manufactured by Indiana General Corporation of Keysbee, New Jersey, or other suitable material. Typically, a relative permeability of at least 2000 is preferable (although at least 40 is suitable) with operating temperature losses of less than 90 mw $cm^{-3}$ at 1000 gauss peak flux density for 50 KHz operation. The ampere-turns of the primary winding must, of course, be greater in lamps having low permeability cores, to maintain the secondary discharge voltage as is well known in the art.

High frequency energy source 16, by producing a constantly varying magnetic field in core 12, creates radiative effects that can result in interference with communications through the atmosphere on radio frequency carriers (known as electromagnetic interference or EMI). That is, the changing magnetic field within core 12 produces a circular electric field threading through the core. Since the core is contiguous to an ionizable medium, a sufficiently strong electric field causes electrical current to flow through a circular path in the ionizable medium producing a time-varying magnetic dipole field which results in undesirable radiation of electromagnetic energy. For any given core size, the strength of this spurious radiation at a large distance from the lamp varies inversely as the fourth power of the wavelength produced by R.F. power supply 16. Hence, the EMI is greater at shorter wavelengths than at longer wavelengths. Nevertheless, the smaller core required at shorter wavelengths, together with reduced hysteresis losses in the core, make it highly desirable to operate lamps of this type at the shorter wavelengths.

For a lamp intended to be used within a lampshade, the present invention facilitates operation at the shorter wavelengths without creating excessive EMI. This desirable result can be achieved by employing the harp of the lampshade as a parasitic antenna element. Thus, if the harp is fabricated of a single conductor in the form of a continuous loop having a major portion situated substantially equidistantly about the center of the toroidal core, and the plane of the loop is oriented normal to the plane of the core 12, the harp is driven by the long range electromagnetic field generated by the transformer core within the lamp, thereby creating an electromagnetic field that opposes the field emanating from the lamp. The net effect is that, at a distance from the lamp, the two electromagnetic fields tend to cancel one another, bringing about a marked reduction in EMI from the lamp. Thus the harp effectively constitutes a passive electromagnetic shield.

To assure proper orientation of the harp with respect to the core, harp 30 is preferably mounted at a fixed orientation with respect to core 12, such that the plane of the harp is always normal to the plane of core 12 regardless of lamp orientation. This result would be attainable only haphazardly, at best, if the harp were formed of a continuous loop and affixed, as is conventional, to the lamp socket. As shown in FIG. 1, however, the plane of harp 30 is rigidly maintained perpendicular to the plane of core 12 by, for example, attaching the harp to a metallic disk 31 at the end of base assembly 14 to which envelope 11 is affixed. The connection between harp 30 and disk 31 may be a weld or other suitable conductive connection, permanent or otherwise, so as to provide a complete, electrically-conductive path about core 12. Disk 31 preferably employs a diametrical bridge 34 to complete the orthogonally-oriented conductive path about core 12.

Harp 30 is provided with a threaded vertical tip 35 at its uppermost location, protruding above a small shoulder 38. Shoulder 38 supports the lampshade (not shown) while threaded tip 35 accommodates a nut (not shown), which may be disguised in ornamental fashion, to hold the lampshade fast onto the harp. Other means for attaching a lampshade to the harp may, of course, be employed. In any event, when the lamp is screwed into its socket, harp 30 rotates in unison with core 12, assuring the proper orientation therebetween at all times. After the lamp has been screwed into its socket, the lampshade is mounted on the harp in conventional fashion by the consumer.

Figure 2:
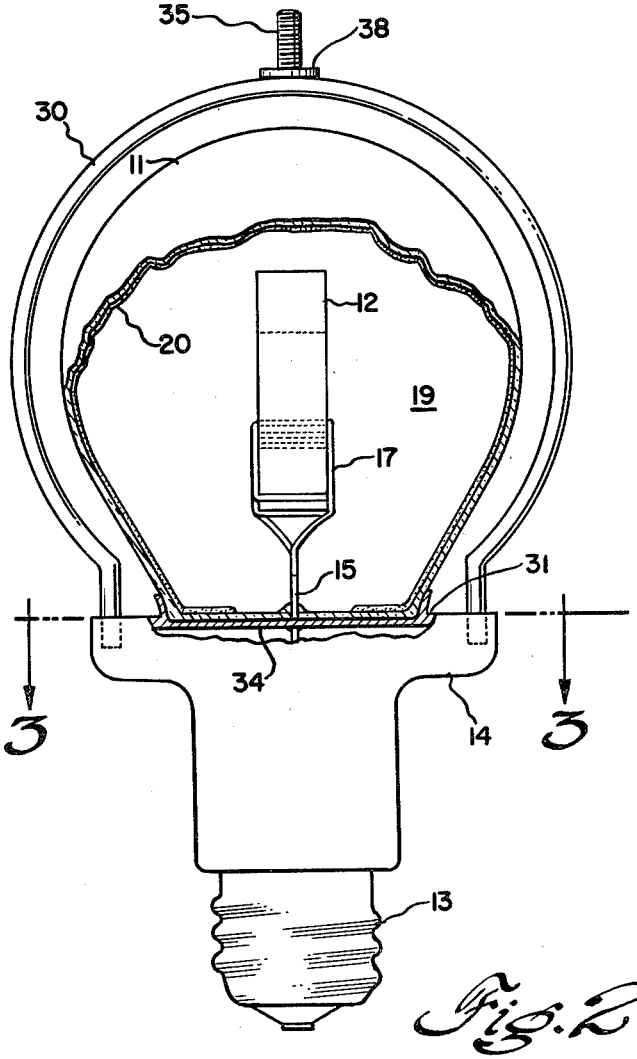
FIG. 2 is a partial sectional view of the lamp of FIG. 1, rotated 90 degrees about its vertical axis.

FIG. 2 illustrates the lamp of FIG. 1, rotated 90 degrees from the position shown in FIG. 1, where like numerals indicate like components. For simplicity of illustration, base assembly 14 is shown in full.

Figure 3:
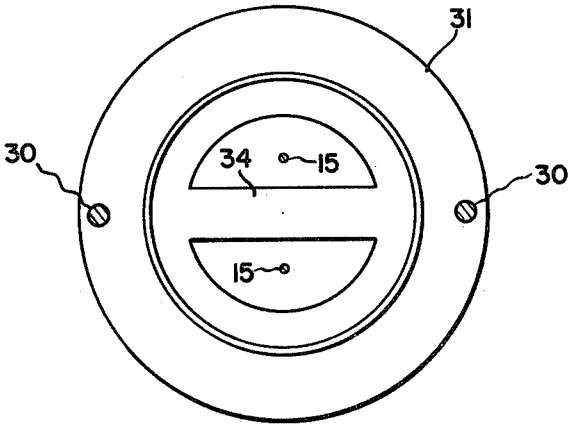
FIG. 3 is a sectional view taken along line 3—3 in FIG. 2.

Disk 31 is shown in FIG. 3 as viewed in a plane along line 3—3 in FIG. 2. The position of metallic pins 15 is such that they are well away from, and thus not in contact with, the inner curved border of the disk and diametrical bridge 34. Harp portions 30 are illustrated at opposite ends of bridge 34, conductively fastened to the disk.

Figure 4:
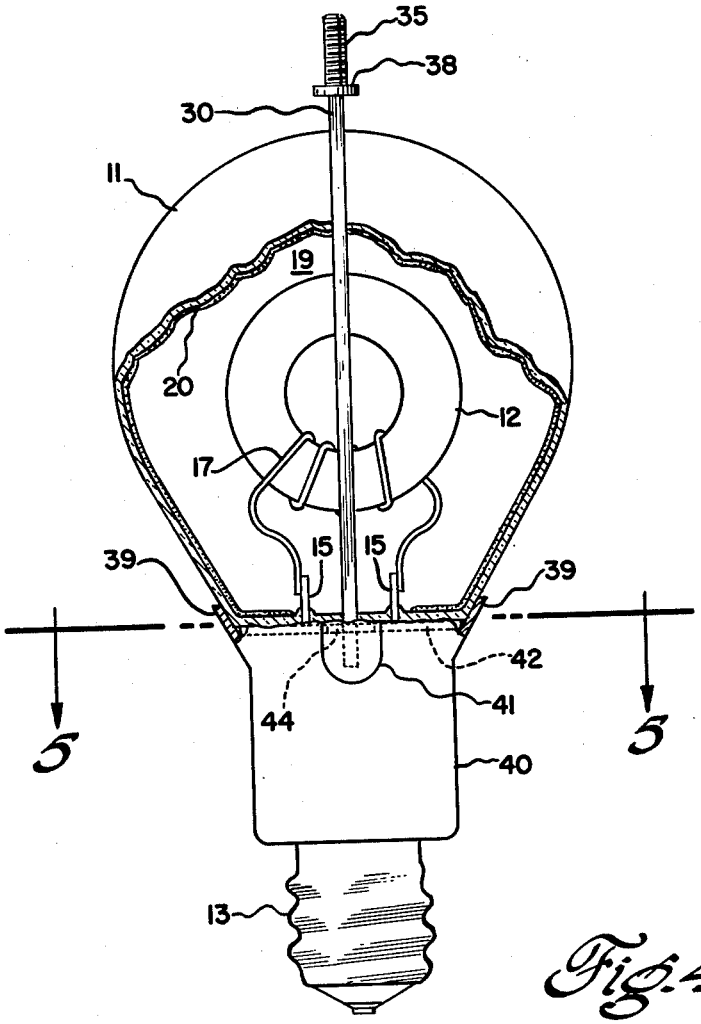
FIG. 4 is a partial sectional view of a modification of the lamp shown in FIGS. 1-3, enabling employment of a base which allows passage of more light toward the threaded end of the lamp.

Using the embodiment of the lamp of the present invention as shown in FIG. 4, where like numerals designate like components, more light reaches the base region of the lamp than when the lamp configuration of FIGS. 1 and 2 is employed. This is because the diameter of lamp base 40 is made only slightly larger than the diameter of envelope 11 where it meets the base (with the exception of a flanged portion 39 providing support for envelope 11) at all but two diametrically opposite protrusions 41 where the base is necessarily enlarged to accommodate harp 30. If the lamp of FIG. 4 is rotated 90 degrees, its outline is essentially identical to that of the lamp illustrated in FIG. 2.

Figure 5:
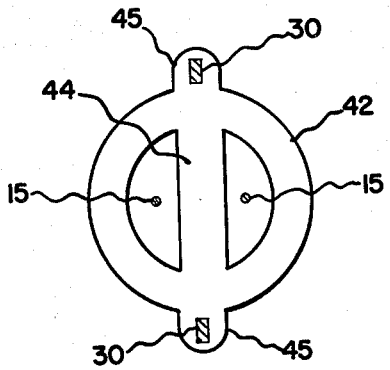
FIG. 5 is a sectional view taken along line 5—5 in FIG. 4.

FIG. 5 is a view of disk 42 employed at the location where envelope 11 is joined to base 40, viewed in the plane defined by line 5—5 in FIG. 4. A diametrical bridge 44 through the disk provides a completed conductive path for harp 30 within the plane of the harp. Except for ears 45 on disk 42, which are positioned within the respective base protrusions 41 shown in FIG. 4, the disk is similar to disk 31 shown in FIG. 3.

In each embodiment of the invention, the cross-sectional shape of harp 30 has not been discussed. To be effective to a maximum extent, however, a rectangular harp cross section can exhibit reduced inductance as well as resistance, and hence is more advantageous than the circular cross section generally used on lamp harps. By constructing the harp such that the long dimension of its rectangular cross section lies in the radial direction from the lamp center, as shown in FIG. 5, light interception by the harp is minimized while the volume of metal available to conduct the eddy currents is maximized. The skin effect prevents other than the surface layer of the metal used in the harp from conducting much current.

The foregoing describes an electrodeless fluorescent lamp exhibiting reduced EMI. By providing a harp mounted about the lamp at a fixed orientation with respect to the lamp, spurious electromagnetic radiation at a distance from the lamp is reduced, without need for adding any new parts to the lamp power supply. As much as a 10–20 db reduction in EMI from the lamp may be obtained by employing the invention described and claimed herein.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

What is claimed is:

1. A fluorescent lamp exhibiting reduced electromagnetic interference comprising:

an evacuable, light-transmissive envelope of generally globular configuration;

a toroidally-shaped magnetic core;

means coupled to said core for establishing a radio frequency magnetic field about said core;

a gaseous medium within said envelope adapted to sustain an electrical discharge when subjected to said radio frequency magnetic field established about said core and to emit radiation at a first wavelength when sustaining said discharge;

a phosphor coating disposed on the interior surface of said envelope and adapted to emit visible light when excited by radiation of said first wavelength; and a continuous, conductive loop situated about said envelope and said core, the plane of said loop being oriented substantially normal to the plane of said core, such that the radio frequency magnetic field about said core induces current within said loop that establishes a radio frequency magnetic field tending to cancel, at a distance from said lamp, the radio frequency magnetic field established about said core.

2. The apparatus of claim 1 wherein said lamp includes a base affixed to said envelope, and means connecting said loop to said base.

3. The apparatus of claim 2 including means within said base for providing a conductive path within the plane of said loop between locations where said loop is connected to said base.

4. The apparatus of claim 2 including means for attaching a lampshade to said loop.

5. The apparatus of claim 3 including means for attaching a lampshade to said loop.

6. The apparatus of claim 1 wherein a major portion of said loop is positioned substantially equidistantly about the center of said toroidal core.

7. The apparatus of claim 6 wherein said lamp includes a base affixed to said envelope, and means connecting said loop to said base.

8. The apparatus of claim 7 including means for attaching a lampshade to said loop.

9. The apparatus of claim 1 wherein said loop is of rectangular cross section with the long dimension of said cross section lying in the radial direction from the lamp center.

* * * * *